United States Patent [19]

Wedertz et al.

[11] Patent Number: 4,586,681

[45] Date of Patent: May 6, 1986

[54] SUPERSONIC ERECTABLE FABRIC WINGS

[75] Inventors: Larry D. Wedertz, Mira Loma; David L. Leslie, Claremont; John A. Karish, Alta Loma, all of Calif.

[73] Assignee: General Dynamics Pomona Division, Pomona, Calif.

[21] Appl. No.: 508,392

[22] Filed: Jun. 27, 1983

[51] Int. Cl.[4] ..... B64C 3/56

[52] U.S. Cl. ..... 244/49; 244/3.27

[58] Field of Search ..... 244/3.24, 3.26, 3.27, 244/3.28, 3.29, 46, 49, 91, 218, DIG. 1

[56] References Cited

U.S. PATENT DOCUMENTS

| | | | |
|---|---|---|---|
| 1,181,203 | 5/1916 | Alard | 244/3.28 |
| 1,243,542 | 10/1917 | Moore | 244/3.27 |
| 1,300,708 | 4/1919 | Edison | 244/3.27 |
| 1,315,721 | 9/1919 | Hall | 102/400 |
| 1,321,668 | 11/1919 | Misener | 102/400 |
| 1,702,717 | 2/1929 | Brodie | 102/400 |
| 1,879,840 | 9/1932 | Brandt | 244/3.29 |
| 2,365,577 | 12/1944 | Moore | 244/3.28 |
| 2,433,234 | 12/1947 | McHugh | 102/400 |
| 2,559,827 | 7/1951 | Northrop | 244/91 |
| 2,654,320 | 10/1953 | Schmid | 244/3.28 |
| 2,666,387 | 1/1954 | Richey | 244/3.27 |
| 3,010,677 | 11/1961 | Guthrie et al. | 244/3.21 |
| 3,092,355 | 6/1963 | Brown | 244/218 |
| 3,125,956 | 3/1964 | Kongelbeck | 244/3.29 |
| 3,185,412 | 5/1965 | Rogallo | 244/49 |
| 3,304,030 | 2/1967 | Weimholt et al. | 244/2.28 |
| 3,312,428 | 4/1967 | Guin | 244/218 |
| 3,563,495 | 2/1971 | Korn | 244/3.29 |
| 3,695,556 | 10/1972 | Gauzza et al. | 244/3.28 |
| 3,788,578 | 1/1974 | Sweeney et al. | 244/3.28 |
| 3,826,448 | 7/1974 | Burk | 244/3.27 |
| 3,986,684 | 10/1976 | Marburger et al. | 244/3.28 |
| 3,990,656 | 11/1976 | Minnich | 244/3.27 |
| 4,135,686 | 1/1979 | Herpfer | 244/3.27 |
| 4,351,499 | 9/1982 | Maudal et al. | 244/3.27 |
| 4,364,531 | 12/1982 | Knoski | 244/3.27 |
| 4,411,398 | 10/1983 | Wedertz et al. | 244/3.28 |

*Primary Examiner*—Trygve M. Blix
*Assistant Examiner*—Rodney Corl
*Attorney, Agent, or Firm*—Neil F. Martin; Edward B. Johnson

[57] ABSTRACT

An erectable wing structure for a supersonic airframe that is stowable within the body of the airframe includes a housing defining an elongated cavity in which is mounted a wing supporting strut assembly having an elongated leading edge strut pivoted at one end within the stowable cavity and including a trailing strut that is foldable and pivotally connected at one end to the cavity structure and at the other end to the outer end of the leading edge strut and including a single layer of fabric stretched between the strut and clamped between the strut structure made up of separable, mirror image, strut links.

22 Claims, 14 Drawing Figures

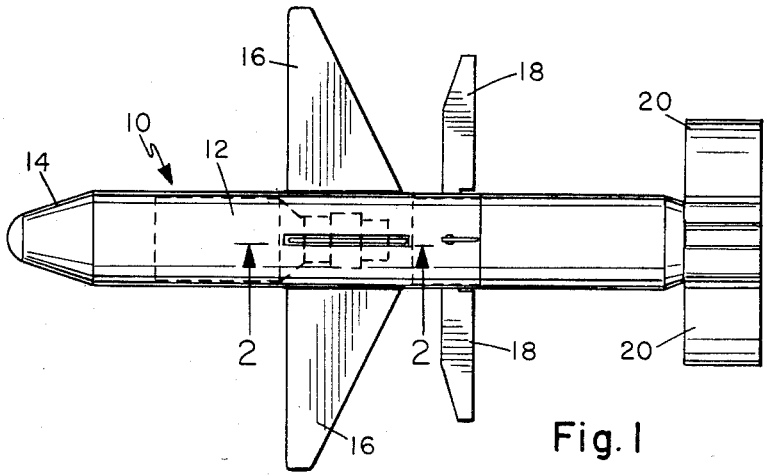
Fig. 1
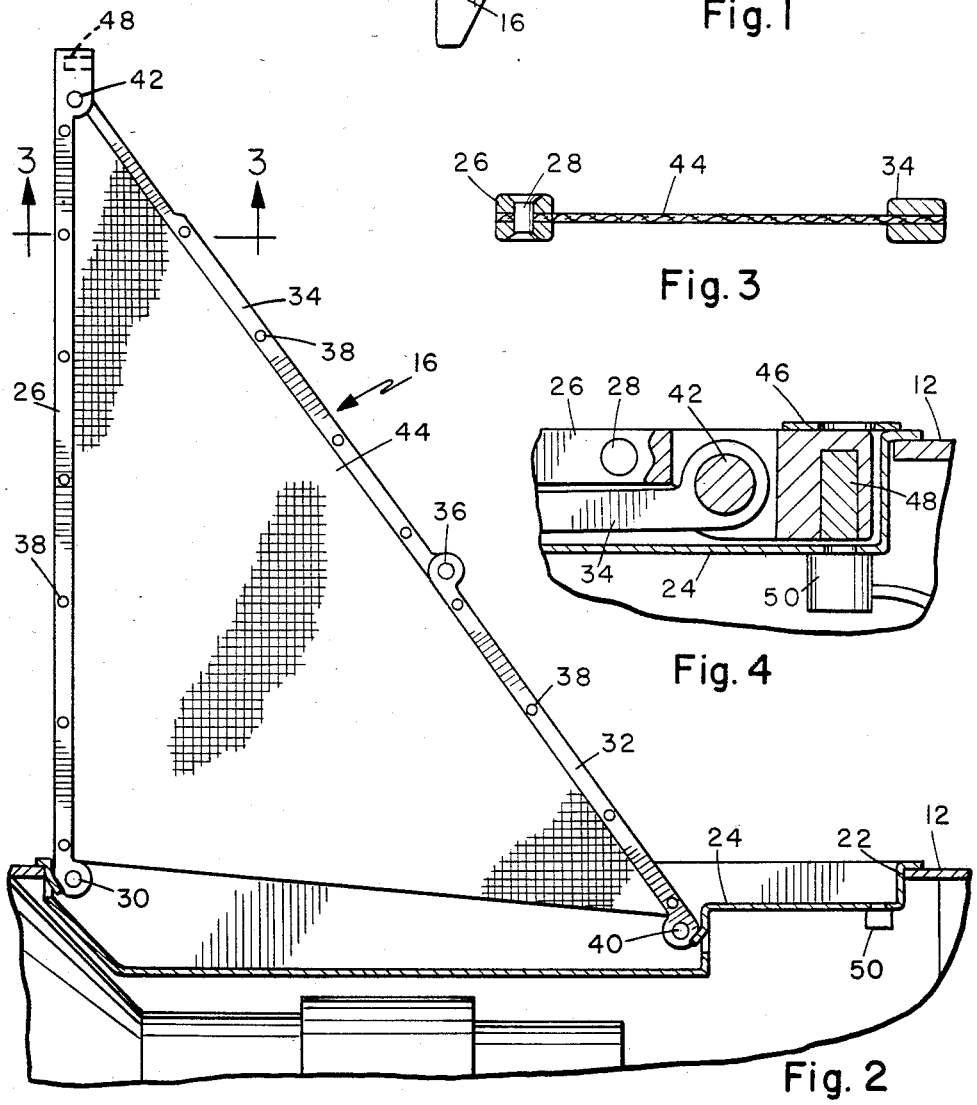
Fig. 2
Fig. 3
Fig. 4

SUPERSONIC ERECTABLE FABRIC WINGS

BACKGROUND OF THE INVENTION

The present invention relates to aircraft structure and pertains particularly to foldable, erectable, wings for high speed or supersonic aircraft.

High velocity airframes, such as missiles, utilize various forms of air foils for lift control and stability. Such air foils are typically in the form of foldable, erectable, wings to facilitate stowing and launching of the missiles. Various forms of foldable and erectable fins or wings have been proposed in the past.

The erectable wing structure should ideally take up a minimum amount of space and should be symmetrical for optimum control and stability. Fabric wings have proven to be the most promising in this regard.

It is desirable, however, that such wings have minimum drag, yet be rigid and durable.

SUMMARY AND OBJECTS OF THE INVENTION

It is, therefore, the primary object of the present invention to provide an improved erectable wing structure for supersonic airframes.

In accordance with the primary aspect of the present invention, an erectable wing structure includes a strut assembly including a leading strut pivotally mounted within a cavity and serving to close the cavity when in the retracted position and to extend outward and support the wing structure in the extended position and include a trailing edge strut structure that is foldable beneath the leading edge strut into the cavity and including a fabric wing structure stretched and supported between the strut structure.

Another aspect of the invention utilizes a perforated restraining band to retain the wings in the folded position and an explosive charge for breaking the constraining band and forcing the wings to the extended position with latch means holding the wings in the extended position.

BRIEF DESCRIPTION OF THE DRAWINGS

The above and other objects and advantages of the present invention will become apparent from the following description when read in conjunction with the drawings wherein:

FIG. 1 is a side elevation view of a typical missile with the wings extended;

FIG. 2 is an enlarged sectional view taken on line 2—2 of FIG. 1;

FIG. 3 is an enlarged sectional view taken on line 3—3 of FIG. 2;

FIG. 4 is an enlarged view similar to a portion of FIG. 2 showing the wing leading edge in stowed position;

DETAILED DESCRIPTION OF A PREFERRED EMBODIMENT

Figure 5:
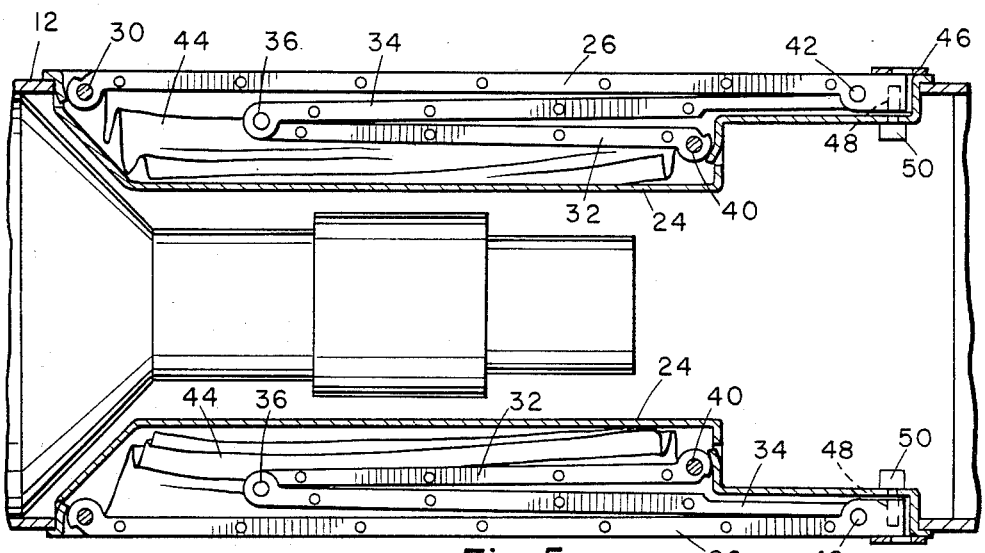
FIG. 5 is a sectional view similar to FIG. 2 but with the wings stowed.

Referring to FIG. 1 of the drawings, there is illustrated a missile designated generally by the numeral 10 and having an elongated generally cylindrical body 12 with a nose cone 14 and a plurality of generally triangular-shaped radially extending erectable wings 16 extending radially outward from the cylindrical body. A plurality of steerable fins 18 extend radially outward from the cylindrical body 12 aft of the erectable wings 16 and stabilizing fins 20 are mounted on the tail end of the missile body.

Turning to FIG. 2 of the drawing, a detailed illustration of the erectable wing is shown. The wing structure is designed to occupy minimum space in an area just aft of the warhead.

The missile body 12 is formed of an outer generally cylindrical shell or skin structure having a plurality of elongated longitudinally oriented generally rectangular slots, consisting in four in number in the illustrated embodiment, formed in the skin structure. Each wing structure, as illustrated in FIG. 2, includes a housing 24 of a generally elongated rectangular construction in plan view fitting within the slots 22 within the missile body. The housings 24 define a wing receiving cavity for accommodating the folded wing assembly.

The folding wing comprises a strut assembly comprising an elongated leading edge strut 26 made up of a lamination of mirror image strut members secured together along its length by means of rivets or the like 28. The strut is pivotally mounted at its inner end on a pivot pin or shaft 30 mounted within the cavity of the housing 24 and folds down to a closed position or stowed position as shown in FIG. 5, filling and covering the elongated opening in the housing 24 as will be seen in FIG. 9.

A trailing strut made up of an inner strut member 32 and an outer strut member 34 pivoted together at a central pivot pin 36 is similarly made up of identical or mirror image elongated link members secured together by means of a plurality of rivets or the like 38. The trailing link is pivotally mounted by means of a hinged pin 40 to the housing 24 in an extended depression portion thereof forward of the back end of the housing. The outer end of outer strut member 34 is pivotally connected by means of a pivot pin 42 to the outer end of the leading strut member 26 forming a generally triangular configured wing support structure having a generally radial straight leading edge. Central pivot pin 36 is an over-center pivot pin, that is when the wing is extended the central pivot pin 36 lies outside of a line between hinge pin 40 and pivot pin 42. Thus, axial forces on the trailing strut do not collapse the strut but latch the strut in the extended position.

A generally triangular-shaped fabric wing covering 44 is mounted and supported within the framework defined by the strut structure. This fabric structure 44 is preferably formed of a single layer of fabric material, such as man-made fabric, plastic or rubber impregnated woven fabric or the like and preferably air impervious. This wing cover or structure is clamped or sandwiched between the double strut structure, as shown in FIG. 3, providing a solid leading edge formed by the strut member 26 providing a more rigid structure better suited for supersonic flight. The structure also provides a compact assembly easily stowable aboard a missile.

The leading strut 26 is of a length to fit directly within the opening of the housing cavity such that when it is folded to its stowable position the strut 26 forms or acts as a cover or closure completely closing the cavity and streamlining the body of the missile.

Figure 9:
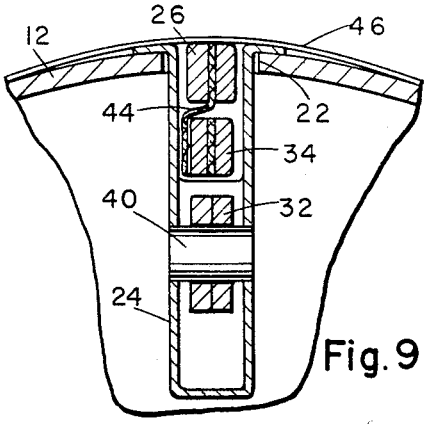
FIG. 9 is a sectional view taken on line 9—9 of FIG. 8.

The wing when folded in its stowed condition, as shown in FIGS. 5 and 9, is held in place by means of a perforated destructible band 46 which extends around the outer end of the struts as they lie in the folded position against the body or within the cavity of the wing housing. Means for erecting the wings include a propellant charge 48 in a cavity formed at the outer end of the leading edge strut 26 which registers upon being stowed with an ignition device 50 for igniting the propellant charge 48 for initially breaking the restraining straps 46 and propelling the outer ends of the struts to the outermost erected position. This eliminates the need for springs for forcing the strut assembly into the erected, or extended, position.

Figure 6:
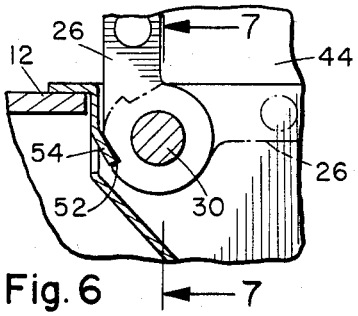
FIG. 6 is an enlarged view of a portion of FIG. 2, showing the forward hinge structure.
Figure 8:
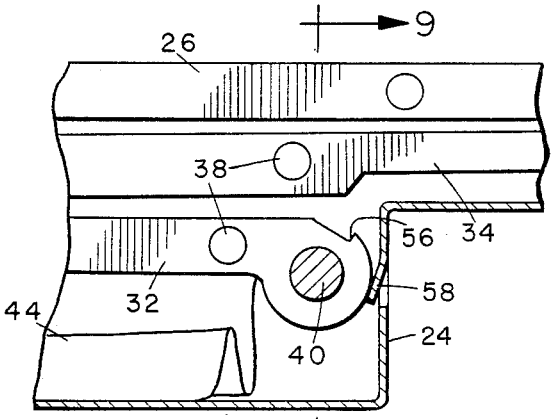
FIG. 8 is an enlarged view of a portion of FIG. 5, showing the aft hinge structure.
Figure 7:
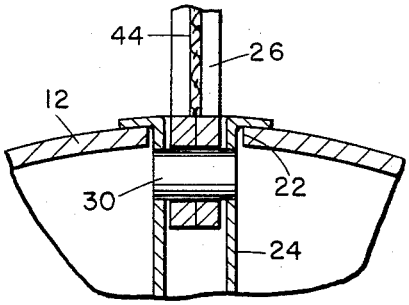
FIG. 7 is a sectional view taken on lines 7—7 of FIG. 6.

Turning to FIGS. 6 and 8, the struts are provided with latching means for retaining the wings in the extended latched position. The latch structure includes a notch 52 formed on the inner end of the strut 26 engageable with a spring latch 54 formed in the housing structure 24.

The trailing strut member 32 similarly includes a latching notch 56 formed on the inner end thereof with a latching tab 58 formed in the housing 24 for engaging the latching notch 56.

After the missile is launched in flight and at the point that it is desirable to extend the wings 16, the ignition charge 50 activates the propellant charge 48 forcing the end of the strut outward breaking the restraining bands 46, freeing the wings to move outward to the extended position as illustrated in FIGS. 1 and 2.

In its stowed position, the wing folds as illustrated in FIG. 5, such that the fabric covering is stowed beneath the strut members with the strut members folded as illustrated with the leading strut member overlying the folded trailing strut assembly.

With the stationary hinge pin 40 of the trailing strut assembly being forward of the trailing end of the housing cavity, and the link 32 shorter than the link 34, the leading edge strut 26 overlies the folded links 32, 34 in the housing when the wings are in the stowed position, as shown in FIG. 5.

Figure 10:
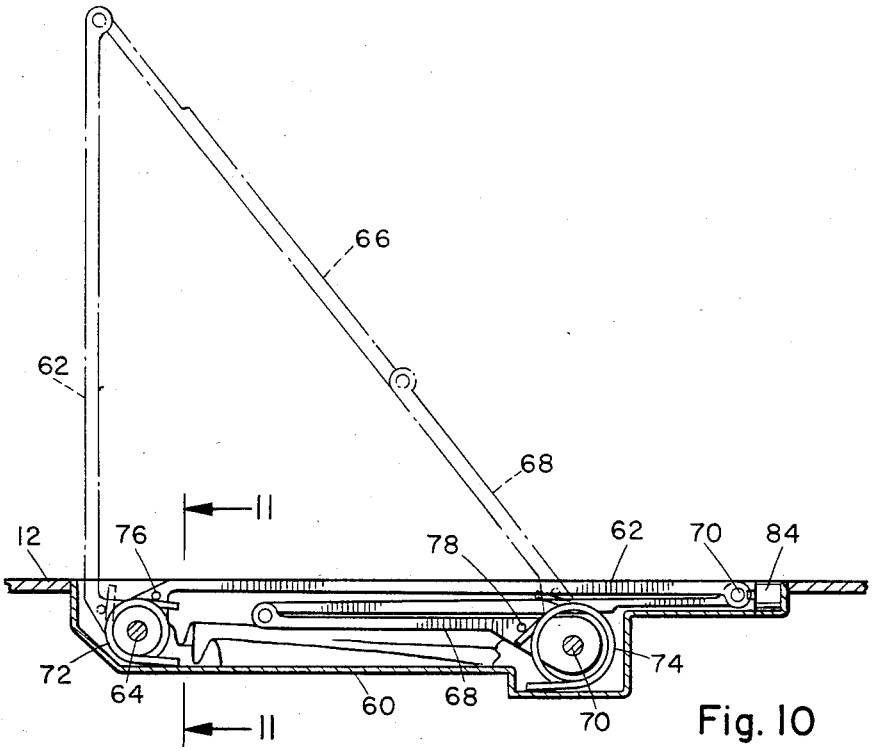
FIG. 10 is a view similar to FIG. 2, showing an alternative spring erection system.
Figure 11:
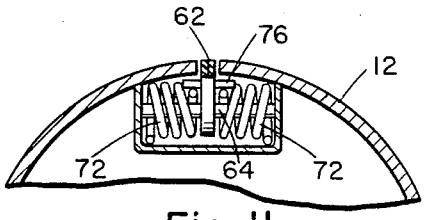
FIG. 11 is a sectional view taken on line 11—11 of FIG. 10.
Figure 12:
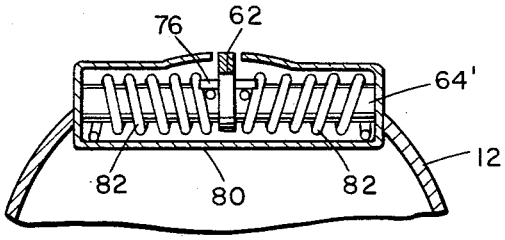
FIG. 12 is a similar sectional view showing means for enclosing a larger spring.

Referring to FIGS. 10 through 12 an alternate embodiment is illustrated wherein the wing structure is erected by means of torsion springs. In this embodiment in wing assembly contained within a housing 60 fits within a longitudinal slot in the shell or body 12 of the missile. The wing assembly includes a strut arrangement with a geometrical configuration substantially like that with regard to the FIG. 2 embodiment. The wing includes a forward strut 62 pivoted at a lower end on a pivot pin 64 within the housing 60, with a two-piece trailing strut comprising an outer link 66 and an inner link 68 pivoted together and to the outer end of the leading strut 62. The link 68 of the trailing strut is pivotally mounted by means of a pivot pin 70 in the aft portion of the housing 60. The housing 60 is configured to accommodate the necessary wing structure without undue intrusion into the valuable space within the body of the missile. The wing is erected by means of a spring assembly comprising a pair of torsion coil springs 72 which are mounted in the housing at the forward end thereof coiled around the pivot pin 64 and in driving engagement with opposite ends of a drive pin 76 extending through the link 62.

A similar erecting spring assembly comprising a pair of springs 74 are mounted on the aft pivot pin 70 and with ends thereof engaging the bottom of the housing and a pin 78 extending through the base of the trailing link 68. The springs are placed under tension (i.e. wound) with the wing in the elected position that when the wing is folded to its stowable position, additional force is placed in the springs by further winding of the springs. It has been found that springs producing adequate energy to erect a wing can be accommodate in a structure of the above described and illustrated configuration.

A slight protrusion of the wing housing beyond the outer diameter of the missile can be accommodate in some designs as illustrated in FIG. 12. As shown in FIG. 12, a housing 80 fitted within a slot of missile housing 12 protrudes slightly beyond the outer surface of the missile housing and accommodate the FIG. 10 wing structure. A pair of coil torsion spring 82 are mounted on an elongated pivot pin 64 in housing 80 and drivingly engage pin 76 on link member 62. A similar arrangement, not shown, may be provided for the trailing link. Therefore, adequate power can be developed by the use of springs to effect an erection of the wings.

The wing of the FIG. 10–12 embodiment folds down as in the previously described FIG. 2 embodiment with the forward link folding over the pivot of the trailing links lying within the housing below the outer surface of the missile housing. A remote releasably latch 84 is positioned within the housing 60 for engaging the link 62 for retaining the wing in its retracted or stowed position until erection is desired. The latch 84 may be a solenoid or similar actuated latch which upon releasing the engagement of link 62 permits the torsion springs to rapidly rotate the links of the wing assembly to the erected position. The springs are preferably tensioned to maintain a sufficient force to latch the wings in the extended position.

Figure 13:
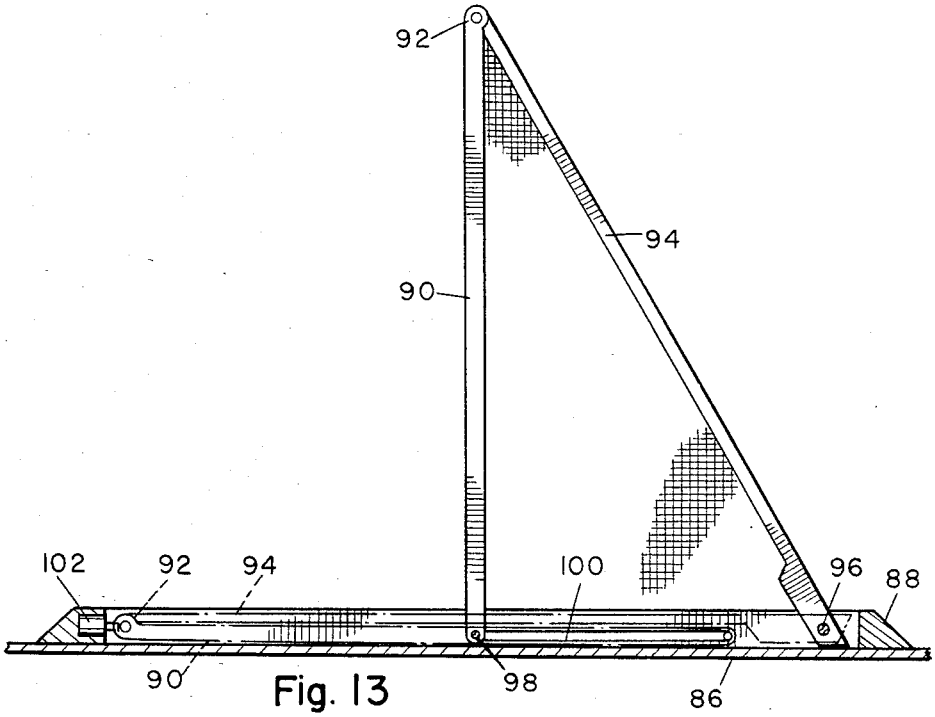
FIG. 13 is a view similar to FIG. 2, showing an alternative aerodynamic erection arrangement.
Figure 14:
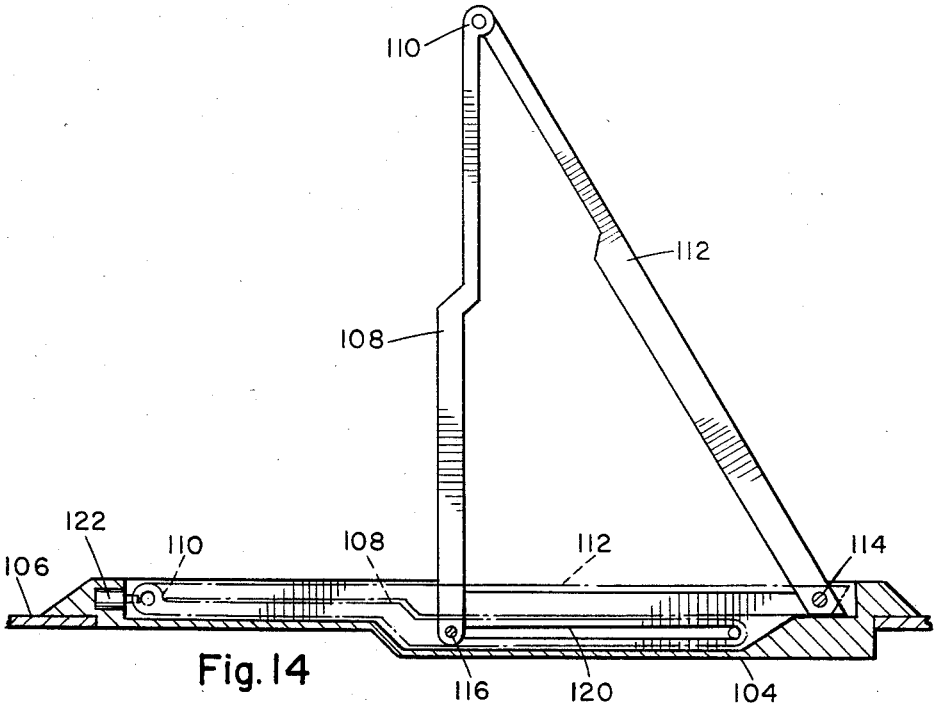
FIG. 14 is a view similar to FIG. 13, showing a modified arrangement for a heavier strut structure.

Referring to FIGS. 13 and 14, a further embodiment is illustrated wherein the link geometry of the wing assembly is slightly different. This illustrates an embodiment in FIG. 13 which may be bonded or strapped to the exterior surface of a missile body or surface 86. The wing assembly comprises a housing structure 88 which forms an elongated slot within which is pivoted for folding a wing assembly having a leading strut 90 pivotally connected at its outer end 92 to a trailing strut 94. The trailing strut 94 is pivotally mounted by means of a pin 96 at the aft end of the housing structure 88. The forward link 90 is pivotally mounted by means of a pin 98 which is slideably mounted within a slot 100 within the housing 88. The wing is constructed as in the previous embodiments, sandwiching a fabric wing panel between mirror image link members making up the aforementioned support links. The wing assembly when folded to its stowed position, as shown in phantom in FIG. 13, lies within the slot in housing 88 with the outer end of the links extending to the forward end of the housing within the slot for engagement by means of a remotely actuated latching device 102 which may be solenoid or explosively actuated. The wing is designed to use the airflow passing over the missile for deployment of the wing. As soon as the wing is released by the latch 102, air flowing over the missile body forces the outer end of the wing outward and backward and causes an erection of the wing.

Referring to FIG. 14, an embodiment of the wing structure similar in general geometric configuration to that previously described (FIG. 13) is illustrated. This embodiment provides a higher strength frame structure for the wing. In this embodiment, a housing 104 is designed to sit partially outside the missile body 106 and to partially extend within the missile body. The housing 104 sits within a slot within the missile body and defines an elongated longitudinally extending slot within which is folded the wing structure. In this embodiment a forward link 108 has an inner widened portion at the inner end providing a stronger structure than in the previous embodiment. The outer end of link 108 is thinner than the inner end and is offset from the axis of the inner end. This link is pivotally connected by a pin 110 to the trailing link 112 which also has a wider, lower portion for reinforcing purposes with an offset or recessed outer portion accommodating the offset outer end of the leading link 108. The trailing link is pivoted by a fixed pin 114 to the housing 104 at the aft end of the slot therein. The forward link 108 is pivotally mounted by a pin 116 in a slot 120 within the housing 104. The housing 104 has a stepped bottom or floor for accommodating the offset portions of the links 108 and 112. A releasable latch assembly 122 engages the link 108 at the outer end thereof for retaining it in the stowed or collapsed position. Upon release of the latch 122 the flowing air passing over the wing forces the outer tip of the wing outward and backward forcing the inner end of link 108 and pin 116 to move forward in slot 120 and causes the wing to extend outward and become erected. The pin 116 slides to the rear of the slot 120 upon the collapsing of the wing and slides to the forward end of the slot upon erection of the wing.

While we have illustrated and described our invention by means of specific embodiments, it is to be understood that numerous changes and modification may be made therein without departing from the spirit and scope of the invention as defined in the appended claims.

We claim:

1. A folding erectable wing structure for an airplane and suitable for full erection during supersonic flight, said wing structure comprising:

housing support means defining an elongated slot including an elongated cavity and an opening;

a wing supporting strut assembly mounted in said cavity and comprising;

an elongated leading strut pivotally mounted at an inner end within said cavity, extending substantially the length of said cavity, and extendable from a stowable position closing said opening to an extended wing supporting position of approximately 90° to the stowable position;

an elongated foldable trailing strut assembly of at least two joined foldable strut members pivotally mounted at an inner end within said cavity and at the other end to the outer end of said leading strut for folding to a stowable position and for extending to a wing support position; and a wing panel formed of a flexible fabric material secured within the boundaries defined by said strut assembly for defining a wing structure; and a perforated retaining band encircling said airframe and engaging the outer end of said leading strut for restraining said wing in the stowed position.

2. The wing structure of claim 1 wherein said leading strut includes a propellant charge in the outer end thereof and ignition means disposed adjacent said propellant charge for igniting said charge for forcing said strut against said retaining band for destructively releasing said band and erecting said wing structure.

3. A foldable erectable wing structure for an air frame, said wing structure comprising:

housing support means defining an elongated slot including an elongated cavity and an opening; and a wing supporting structure assembly mounted in said cavity and comprising;

an elongated leading strut pivotally mounted at an inner end within said cavity and extendable from a stowable position closing said opening to an extended wing supporting position;

an elongated foldable trailing strut assembly pivotally mounted at an inner end within said cavity and at the other end to the outer end of said leading strut for folding to a stowable position and for extending to a wing support position; and a wing panel formed of a flexible fabric material secured within the boundaries defined by said strut assembly for defining a wing structure; and wherein said leading strut and said trailing strut are each formed of a wide inner portion extending from the inner end up to about one-half the length thereof and a narrow outer portion extending from said inner portion to the outer end thereof.

4. The wing structure of claim 3 wherein said outer portion of each of said structure is offset from the inner end and are closely nestled together when in the stowable position.

5. A folding erectable wing structure for an air frame, said wing structure comprising:

housing support means defining an elongated slot including an elongated cavity and an opening;

a wing support strut assembly mounted in said cavity and comprising:

an elongated leading strut formed of a pair of upper and lower mirror image members laminated together, pivotally mounted at an inner end within said cavity, extendable from a stowable position within said cavity to an extended wing supporting position of approximately 90° to the stowable position, and slideably mounted for moving longitudinally within said cavity when said strut assembly moves between said stowable position and said wing supporting position;

an elongated foldable trailing strut assembly formed of a pair of upper and lower mirror image members laminated together, pivotally connected at one end with said cavity and at the other end to the outer end of said leading strut for folding to a stowable position within said cavity, extending substantially the length of said cavity, substantially closing said opening and for extending to a wing support position; and a wing panel formed of a flexible fabric material sandwiched between said pairs of strut members and secured within the boundaries defined by said struts for defining a wing structure.

6. A folding erectable wing structure for an air frame and suitable for full erection during supersonic flight, said wing structure comprising:

housing support means defining an elongated slot including an elongated cavity and an opening; and a wing supporting strut assembly mounted in said cavity and comprising:

an elongated leading strut formed of a pair of mirror image members laminated together, pivotally mounted at an inner end within said cavity, extending substantially the length of said cavity, and extending from a stowable position closing said opening to an extended wing supporting position of approximately 90° to the stowable position;

an elongated foldable trailing strut assembly of at least two joined foldable strut members formed of first and second pairs of Mirror Image members laminated together, pivotally connected at one end within said cavity and at the other end to the outer end of said leading strut for folding to a stowable position and for extending to a wing support position; and a wing panel formed of a flexible fabric material sandwiched between said pairs of strut members and secured within the boundaries defined by said struts for defining a wing structure.

7. The wing structure of claim 6 wherein said slot is formed in the body of an airframe and said leading strut closes said slot forming streamlined structure of said airframe when said wing assembly is in the stowed position.

8. The wing structure of claim 6 wherein said wing is restrained in the stowed position by a perforated retaining band encircling said airframe and engaging the outer end of said leading strut.

9. The wing structure of claim 8 wherein said leading strut includes a propellant charge in the outer end thereof and ignition means disposed adjacent said propellant charge for igniting said charge for forcing said strut against said retaining band for destructively releasing said band and erecting said wing structure.

10. The wing structure of claim 6 including latch means for latching said wing structure in the erected position.

11. The wing structure of claim 10 wherein said latch means includes a latching notch formed on the inner end of each of said leading and trailing struts and a latching tab engageable with said latching notch when said struts are in the extended position.

12. The wing structure of claim 10 wherein said latch means comprises an over-center pivot pin of said trailing strut for latching said trailing strut in the extended position.

13. The wing structure of claim 6 wherein said housing support means comprises a housing mounted on an airframe body.

14. The wing structure of claim 6 including spring means for biasing said strut assembly to the extended position.

15. the wing structure of claim 14 wherein said spring means comprises a torsion spring drivingly engaging each of said leading and said trailing assemblies in said cavity.

16. A folding erectable wing structure for an air frame, said wing structure comprising:

housing support means defining an elongated slot including an elongated cavity and an opening;

a wing supporting strut assembly mounted in said cavity and comprising:

an elongated leading strut formed of a pair of mirror image members laminated together, pivotally mounted at an inner end within said cavity and extendable from a stowable position closing said opening to an extended wing supporting position;

an elongated foldable trailing strut assembly formed of first and second pairs of mirror image members laminated together, pivotally connected at one end within said cavity and at the other end to the outer end of said leading strut for folding to a stowable position and for extending to a wing support position; and a wing panel formed of a flexible fabric material sandwiched between said pairs of strut members and secured within the boundaries defined by said struts for defining a wing structure; and wherein said leading strut and said trailing strut are each formed with a wide inner portion extending from the inner end up to about one-half the length thereof and a narrow outer portion extending from said inner portion to the outer end thereof.

17. The wing structure of claim 16 wherein said outer portion of each of said struts is offset from the inner end and are closely nestled together when in the stowable position.

18. A folding erectable wing structure for an airplane and suitable for full erection during supersonic flight, said wing structure comprising:

housing support means defining an elongated slot including an elongated cavity and an opening;

a wing supporting strut assembly mounted in said cavity and comprising:

an elongated leading strut pivotally mounted at an inner end within said cavity, extending substantially the length of said cavity, and extendable from a stowable position closing said opening to an extended wing supporting position of approximately 90° to the stowable position;

an elongated foldable trailing strut assembly of at least two joined foldable strut members pivotally mounted at an inner end within said cavity and at the other end to the outer end of said leading strut for folding to a stowable position and for extending to a wing support position; and a wing panel formed of a flexible fabric material secured within the boundaries defined by said strut assembly for defining a wing structure;

said leading strut and said trailing strut assembly each being constructed of laminated upper and lower strut members and said wing panel being sandwiched between said upper and lower strut members; said slot being formed in the body of an airframe and said leading strut closing said slot forming streamlined structure of said airframe when said wing assembly is in the stowed position; and a perforated retaining band encircling said airframe and engaging the outer end of said leading strut for restraining said wing in the stowed position.

19. The wing structure of claim 18 wherein said leading strut includes a propellant charge in the outer end thereof and ignition means disposed adjacent said propellant charge for igniting said charge for forcing said strut against said retaining band for destructively releasing said band and erecting said wing structure.

20. The wing structure of claim 19 including latch means for latching said wing structure in the erected position.

21. The wing structure of claim 20 wherein said latch means includes a latching notch formed on the inner end of each of said leading and trailing struts and a latching tab engageable with said latching notch when said struts are in the extended position.

22. The wing structure of claim 20 wherein said latch means comprises an over-center pivot pin of said trailing strut for latching said trailing strut in the extended position.

* * * * *